US005641023A

United States Patent [19]

Ross et al.

[11] Patent Number: 5,641,023

[45] Date of Patent: Jun. 24, 1997

[54] SHIFTING TOOL FOR A SUBTERRANEAN COMPLETION STRUCTURE

[75] Inventors: Colby M. Ross; Dhirajlal C. Patel, both of Carrollton, Tex.; Ronnie D. Finley, New Iberia, La.

[73] Assignee: Halliburton Energy Services, Inc., Dallas, Tex.

[21] Appl. No.: 511,029

[22] Filed: Aug. 3, 1995

[51] Int. Cl.[6] ..... E21B 34/14

[52] U.S. Cl. ..... 166/386; 166/332.4

[58] Field of Search ..... 166/332.4, 386, 166/373

[56] References Cited

U.S. PATENT DOCUMENTS

| | | | |
|---|---|---|---|
| 3,073,392 | 1/1963 | Dinning et al. | 166/332.4 |
| 3,115,188 | 12/1963 | Cochran et al. | 166/332.4 |
| 3,335,802 | 8/1967 | Seyffert, III | 166/332.4 |
| 4,678,035 | 7/1987 | Goldschild | 166/373 X |
| 4,917,191 | 4/1990 | Hopmann et al. | 166/332.4 X |
| 5,180,016 | 1/1993 | Ross et al. | 166/387 |
| 5,305,833 | 4/1994 | Collins | 166/386 |
| 5,325,917 | 7/1994 | Szarka | 166/332.4 X |
| 5,479,989 | 1/1996 | Shy et al. | 166/332.4 |

OTHER PUBLICATIONS

Production Packer Equipment and Services, Wireline Service Equipment and Subsurface Flow Controls.
Otis Product and Service Catalog, pp. 103–104 and p. 26. Stage Cementing Tools and Mechanical Shifting Tool.
Teledyne Merla Product and Service Catalog, pp. 27–28. Gravel Pack Extensions and Multiple Acting Closing Sleeve.
Baker Product and Service Catalog, pp. 23–24. Horizontal Well Completion Components and Service Tools.
Halliburton Product and Service Catalog, p. 18 and pp. 25–26.

*Primary Examiner*—Hoang C. Dang
*Attorney, Agent, or Firm*—William M. Imwalle; David H. Hitt

[57] ABSTRACT

In a well having a substantially annular completion structure therein, the completion structure having portions of lesser and greater inner diameter and an axially-shiftable element associated with the portion of greater inner diameter, the axially-shiftable element having an inner diameter greater than a diameter of the portion of lesser inner diameter, a shifting tool for, and method of, axially shifting the axially-shiftable element. The shifting tool comprises: (1) a first shifting tool portion having a first shifting profile associated therewith, the first shifting tool portion adapted to pass through the portion of lesser inner diameter and (2) a second shifting tool portion having a second shifting profile associated therewith, the first shifting profile engageable with the second shifting tool portion to cause the second shifting tool portion to move in concert with the first shifting tool portion, the second shifting profile engageable with the axially-shiftable element to cause the axially-shiftable element to move in concert with the second shifting tool portion, the first and second shifting tool portions thereby cooperable to provide substantial axial forces to shift the axially-shiftable element.

78 Claims, 6 Drawing Sheets

SHIFTING TOOL FOR A SUBTERRANEAN COMPLETION STRUCTURE

TECHNICAL FIELD OF THE INVENTION

The present invention is directed, in general, to a shifting tool and a method for using the same in a well bore, and more specifically, to a shifting tool and method for use in a completion structure, such as a wash pipe having a well screen or slotted liner and hydraulic packers associated therewith, generally used in a horizontal or gravel pack well bore.

BACKGROUND OF THE INVENTION

Completion structures of the type disclosed in U.S. Pat. Nos. 5,332,045 and 5,180,016, which are incorporated herein by reference, are often used in horizontal or gravel pack well bores.

These completion structures are generally comprised of several different completion apparatuses that are coupled together and work in concert to perform various completion and testing operations within the well bore. A hydraulically actuated packer of the type disclosed in U.S. Pat. No. 4,832,129, which is incorporated herein by reference, is usually positioned at the upper portion of the bottom hole completion structure and is connected to the earth's surface via a tubular work string and setting tool that extends into the packer assembly. The packer is, in turn, connected to a completion assembly that extends downhole to the end (i.e. "bottom") of the well bore. The purpose of the packer, of course, is to isolate downhole portions of the well bore from the hydrostatic head above the packer.

Located downhole and attached to the setting tool is a tubular extension or wash pipe, a conventional shifting tool having a shifting key and cup-packers associated therewith. The cup-packers are positioned a distance uphole from the shifting tool, and the shifting key is connected to the shifting tool. When the completion structure is initially run into the well bore and positioned on the bottom for fluid circulation, the shifting tool and the cup-packers are typically positioned downhole near the bottom of the completion structure. Both the shifting tool and the cup-packers are coupled to the wash pipe to thereby move with the wash pipe as the wash pipe is pulled uphole via the work string. The cup-packers perform the conventional function of closing ports with the completion tool to change fluid flow path within a portion of the completion tool during different stages of the testing or completion operation.

The shifting tool is used to actuate other devices within the completion tool such as a slidable flapper sleeve that, when actuated, allows a flapper valve to move to a closed position and thereby change or restrict the fluid flow path within another portion of the completion tool. In addition, the shifting tool engages and closes a closing port sleeve, which is positioned between the packer and the flapper valve. The closing of the closing port sleeve also changes the fluid flow path through the completion structure.

Filter screens also form a part of the conventional completion structure. Such filtration devices typically include screens that are used to filter out sand and fines from a geological formation from which gas or oil may be produced. The screens conventionally comprise one or more wrapped wire well screens or one or more dual concentric wrapped wire well screens having an annulus between the concentric screens that have been packed with sand, gravel or epoxy-coated gravel. The screens are typically run in the uncased portion of the well bore to retard the flow of sand fines into the production tubing along with the produced fluids and are positioned across the geological formation between the flapper valve and the bottom of the well bore.

In conventional completion structures and in a manner known to those skilled in the art, the shifting tool and cup-packers simultaneously move with the wash pipe as the wash pipe is pulled uphole to achieve various fluid flow paths that are required in completion and testing operations. As these devices are pulled uphole through the well bore, the cup-packers cover fluid ports and the shifting tool actuates flapper valves and covering sleeves to change the fluid flow path in and around the completion structure as desired.

While these completion structures are quite useful in many horizontal and gravel-pack well bores, they do, by their conventional design, impose certain limitations within the completion structure. For example in conventional systems, the bores within the completion tool, including the screens, are such that the shifting tool size, the cup-packer size and the flapper size are all relatively the same. Thus, conventional shifting tools have been limited to those completion structures that have a consistent inside diameter bore throughout the length of the tool in which the various shifting operations and port closing operations occur.

This limitation presents a problem in that when for example screens having a small inside diameter relative to the packer and closing sleeve are attached to the completion structure, conventional shifting keys are not able to expand far enough to engage a sleeve shoulder in a bore having a larger inside diameter, since there may be as much as ⅜" to 1" difference in the inside diameter between the bore downhole and the bore where the flapper valve and closing sleeve are positioned.

While there are shifters that will extend from the centerline of the completion structure bore to engage a larger size inside diameter, they are limited in the amount of load that they can withstand. The reason these conventional shifters are limited is that as they extend farther, the tool strength that is available and necessary to shear a shear pin or apply force that allows other shifting operations to occur becomes less.

A problem arises in those instances where it is desirable to have a larger inside bore diameter in those portions of the completion structure in which the flapper valve and the closing sleeve are located. One such instance is where it is desired to have more fluid flow or by-pass area between the wash pipe and the packer mandrel. Greater by-pass area is desirable because in some configurations where the space between the wash pipe and the packer mandrel becomes too small, solids in the fluid can build up in those restricted areas and plug it off, thereby affecting the fluid flow in the system. In these instances, the conventional shifters are not well suited because if the inside diameter of the filter screens are ⅜" to 1" smaller than the inside bore diameter in which the flapper valve and closing sleeve are located, the shifter will fail to properly engage and shift those devices. As such, a new completion tool has to be built for each wash screen size to accommodate the smaller inside diameters of each varying size of wash screen, which, thereby, increases the costs associated with the use of the tool.

Therefore, it is seen that there is a need in the art for a shifting tool that can be used in different bore sections of a completion structure having differing inside diameters. The shifting tool of the present invention provides a shifting tool that addresses the deficiencies of the prior art.

SUMMARY OF THE INVENTION

To address the above-discussed deficiencies of the prior art, the present invention provides, in a well having a substantially annular completion structure therein, a completion structure having portions of lesser and greater inner diameter and an axially-shiftable element associated with the portion of greater inner diameter wherein the axially-shiftable element has an inner diameter greater than a diameter of the portion of lesser inner diameter, a shifting tool for, and method of, axially shifting the axially-shiftable element. The shifting tool comprises: (1) a first shifting tool portion having a first shifting profile associated therewith, the first shifting tool portion adapted to pass through the portion of lesser inner diameter and (2) a second shifting tool portion having a second shifting profile associated therewith. The first shifting profile is engageable with the second shifting tool portion to cause the second shifting tool portion to move in concert with the first shifting tool portion. The second shifting profile is engageable with the axially-shiftable element to cause the axially-shiftable element to move in concert with the second shifting tool portion. The first and second shifting tool portions thereby cooperate to provide substantial axial forces to shift the axially-shiftable element.

Thus, the present invention introduces a shifting tool that is adapted to shift elements of potentially widely-varying inner diameter. With prior art shifting tools, shiftable elements uphole of the portion of lesser inner diameter were constrained to have an equivalently lesser diameter, thereby undesirably constricting the completion structure and concomitantly limiting access to, and use flexibility of the completion structure. The present invention provides, in effect, a radial expansion member (in the form of the second shifting tool portion) to allow the shifting tool to shift shiftable elements of larger inner diameter without compromising the level of axial forces that can be brought to bear on the shiftable elements.

In a preferred embodiment of the present invention, the first shifting profile is located on a key coupled to the first shifting tool portion. In this embodiment, a shifting key projects radially from the first shifting tool portion. The profile is predetermined to engage a matching profile on the inner surface of a surrounding member. In the present invention, the surrounding member is the second shifting tool portion, although the surrounding member could as well be a second axially-shiftable element of lesser inner diameter.

In a more preferred embodiment of the present invention, the key has a spring associated therewith, the spring urging the key away from a centerline of the first shifting tool portion. The spring resiliently urges the key toward an extended position, allowing the key to seek a matching profile.

In a preferred embodiment of the present invention, the first shifting profile is integral with an outer surface of the first shifting tool portion. In lieu of a key, the first shifting profile may simply be machined or otherwise formed in the outer surface of the first shifting tool portion. In a more preferred embodiment of the present invention, the first shifting profile is a shoulder on the outer surface, the shoulder engaging with an inner surface of the second shifting tool portion.

In a preferred embodiment of the present invention, the second shifting profile is integral with an outer surface of the second shifting tool portion. As with the first shifting profile, the second shifting profile may be embodied as a key, perhaps spring-loaded. However, as will be seen, the second shifting tool portion is not very thick. Thus, the second shifting profile should preferably be adapted for employment in the relatively thin wall of the second shifting tool portion. In a more preferred embodiment of the present invention, the second shifting profile is located on a plurality of collet fingers formed from the outer surface. The collet fingers may be resiliently urged radially inwardly to retract the second shifting profile inward, thereby allowing the second shifting profile to engage with a matching profile on an inner surface of the axially-shiftable element.

In a preferred embodiment of the present invention, the completion structure has a valve member and a valve seat associated therewith, with the valve member being movable between an open position and a closed position. The second shifting tool portion retains the valve member in an open position prior to its movement by the first shifting tool portion. The valve member and corresponding seat are employed when the completion structure is eventually placed in its operating mode. Until then, the valve must be stowed out of the way of the first shifting tool portion. The present invention preferably employs the second shifting tool portion for this purpose, thereby enhancing the benefits of the second shifting tool portion.

In a preferred embodiment of the present invention, a shearable element joins the second shifting tool portion to the completion structure subject to application of a predetermined shearing force to the second shifting tool portion. Thus, the second shifting tool portion is most preferably set in place with the completion structure. Only when it is desired to run the first shifting tool portion through the completion structure in its operating mode is the second shifting tool portion displaced and employed to advantage.

In a preferred embodiment of the present invention, the completion structure comprises a profile retraction structure adapted to engage the second shifting profile to urge the second shifting profile toward a centerline of the second shifting tool portion, the second shifting profile thereby disengageable from the axially-shiftable element. As previously described, the second shifting tool portion is employed to engage and shift the axially-shiftable element into place. Once that is done, it is desirable to disengage the second shifting tool portion from the axially-shiftable element, leaving the axially-shiftable element in its place. The profile retraction structure does this by urging against the second shifting profile, separating it from a matching profile on the inner surface of the axially-shiftable element.

In a preferred embodiment of the present invention, the completion structure further comprises a retention structure for releasably retaining the axially-shiftable element in a selectable one of first and second positions. The axially-shiftable element has two desired positions: a first, or running, position locates the axially-shiftable element such that radial ports proximate the axially-shiftable element are open to fluid flow; a second, or operating, position locates the axially-shiftable element over the radial ports, substantially blocking radial ports as against fluid flow. The present invention provides the retention structure to ensure that the axially-shiftable element remains in one of the two positions once located there.

In a preferred embodiment of the present invention, the first and second shifting tool portions comprise seals for creating a seal for each of the first and second shifting tool portions, as well as the completion structure, against a flow of fluid. As will be described hereinafter, fluid flow may be deleterious to moving parts within the completion structure. Accordingly, the present invention provides a temporary seal against this flow, thereby allowing the moving parts to assume their operating position free of forces caused by the unwanted flow. Thus, in a more preferred embodiment of the present invention, the seals substantially prevent the flow of fluid as the first and second shifting tool portions are moved relative to the completion structure.

In a preferred embodiment of the present invention, the second shifting tool portion is movable relative to the completion structure to free a flapper valve associated with the completion structure for rotation relative thereto. The valve member, as described above, therefore may be a flapper valve employed to regulate the direction of fluid flow within the completion structure while in its operating mode. However, until the completion structure is placed in its operating mode, it is desirable to stow the flapper valve out of the way. The second shifting tool portion advantageously performs this function.

In a preferred embodiment of the present invention, seals moving relative to the first and second shifting tool portions provide a seal against a flow of fluid, leaving the flapper valve thereby substantially free of influence by forces generated by the flow of fluid. The flapper valve may be one of the moving parts deleteriously affected by substantial fluid flow while it is seating. Therefore, cups below the shifting tool of the present invention temporarily isolates the flapper valve from the substantial fluid flow during the flapper valves initial seating.

In a preferred embodiment of the present invention, the completion structure has a radial port associated therewith proximate the axially-shiftable element. As previously described, the radial port allows fluid flow into or out of the completion structure, preferably before it is placed in its operating mode.

In a preferred embodiment of the present invention, the axially-shiftable element is axially shiftable to block the radial port as against a flow of fluid. One of the steps taken to place the completion structure in its operating mode is to block the radial port.

In a preferred embodiment of the present invention, the portion of lesser inner diameter has a screen associated therewith. The portion of lesser inner diameter often lies within an open hole portion of the well. The portion of greater diameter often lies within a well flow conductor, most often a casing. The screen filters out sand and fines and allows fluids, such a oil or gas, to pass from surrounding earth into the completion structure for eventual carriage to the surface.

In a preferred embodiment of the present invention, the first shifting tool portion has cup packers associated therewith to isolate the screen across a geological formation. As will be described hereinafter, there are a number of conventional operations to be performed between the time a completion structure is set in place and the time it is actually placed in its operating mode. The first shifting tool portion is advantageously employed to perform these conventional operations.

In a preferred embodiment of the present invention, the well is a horizontal well. Alternatively, in a preferred embodiment of the present invention, the well is a gravel-pack well. The present invention finds particular use in these environments, although those of ordinary skill in the art will readily understand that other well configurations, such as conventional vertical wells, are within the broad scope of the present invention.

In a preferred embodiment of the present invention, the shifting tool further comprises means for moving the shifting tool axially through the well and completion structure. The means for moving is broadly defined as including a drillstring, slickline or any other means for transmitting axial or radial forces from the surface to the shifting tool.

In a preferred embodiment of the present invention, the first and second shifting tool portions are completely removable from the completion structure. As will be described, the first and second shifting tool portions are retrieved from the well, leaving the completion structure behind.

In a preferred embodiment of the present invention, the shifting tool is employed to place the completion structure into an operating mode. As the first and second shifting tool portions are axially separated from the completion structure, the completion structure is left in its operating mode, suitable for enabling production of fluids, such as oil or gas, via the completion structure.

In a preferred embodiment of the present invention, a surface rig provides forces to shift the shifting tool axially relative to the well. A conventional drilling rig may be employed to drive the shifting tool. Alternative sources for the necessary forces are, however, within the broad scope of the present invention.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
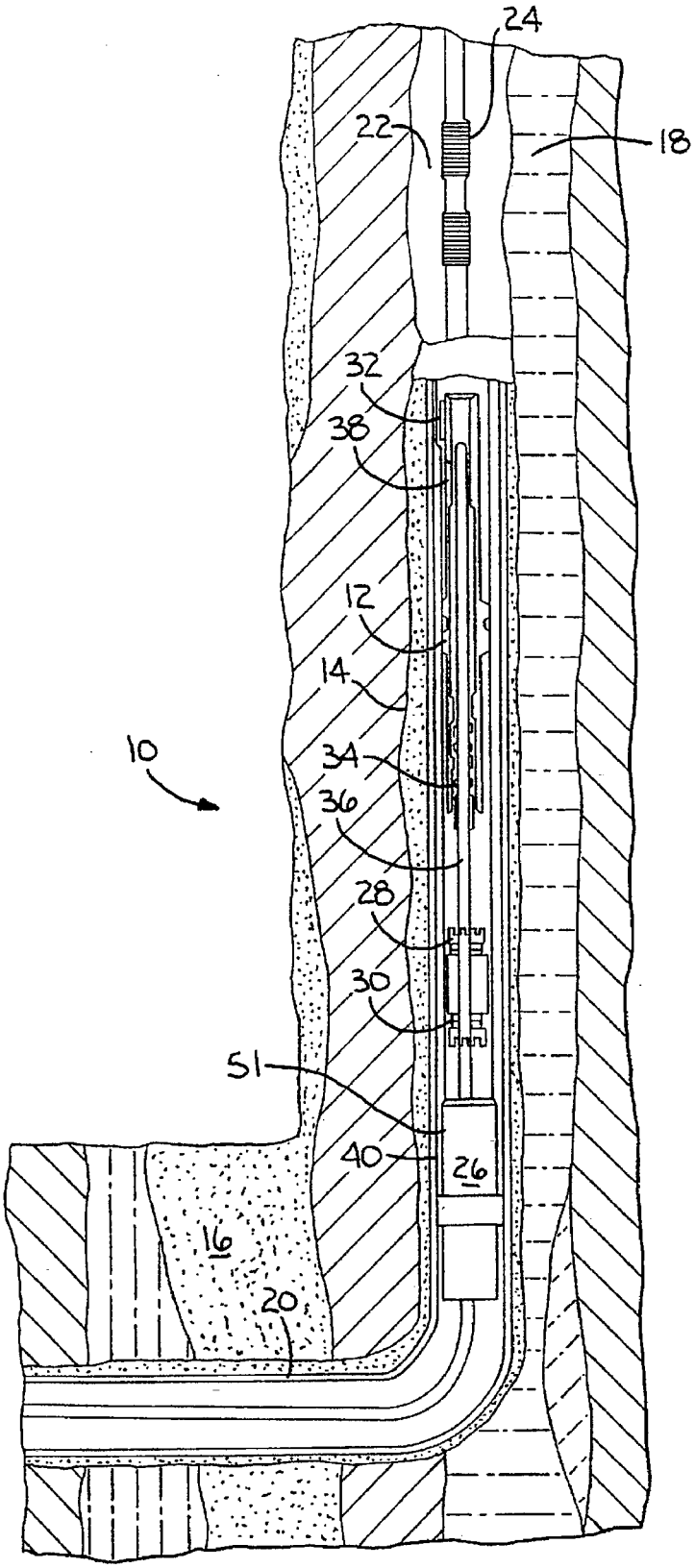
FIG. 1 illustrates a schematic side cut-away view of a completion structure employing the shifting tool of the present invention as they are positioned in a well bore.

Turning initially to FIG. 1, in a preferred embodiment thereof, there is illustrated a completion structure 10 in which the shifting tool 12 of the present invention is used. A well bore 14 is drilled substantially vertically through several layers of geological formations 16 and may, through the use of directional drilling motors, diverters or the like be turned from the vertical to a more or less horizontal orientation for the purpose of either placing as much as possible of the well bore 14 within a producing stratum 18, or for reaching an oil producing formation remote from the vertical portion of the well bore The vertical portion and a horizontal portion of the well bore 14 is typically shored up against collapse by a casing 20 which is cemented in position. As shown, the casing 20 generally extends only a portion of the length of the well bore 14, leaving the balance of the well bore 14 as an open hole 22, which may be prone to erosion or collapse after the well is placed on production.

In order to place the well on production, filtration elements 24 are positioned across the producing geological formation 18. The filter elements 24 are of conventional design and are preferably comprised of one or more wrapped wire well screens having an annulus between the concentric screen which has been packed with sand, gravel or epoxy coated gravel. These screens are commonly referred to as dual screen prepack well screens, or sintered metal tubes. These filter elements 24 are positioned in the open hole 22 port,on of the well bore 14 to retard the flow of sand fines into the production tubing along with the produced fluids.

Positioned uphole from the filter elements 24 are the packer 26, an axially-shifting element 28, such as a ported closing sleeve with an associated closing sleeve, having a shifting profile 30, the shifting tool 12 and a flapper valve 32. The shifting tool 12 is comprised of a first shifting tool portion 34 that is coupled to and moves with a blank pipe 36 and a second shifting tool portion 38 that is coupable to the first shifting tool portion 34. Once coupled to the first shifting tool portion 34, the second shifting tool portion 38 moves in concert with the first shifting tool portion 34 and the blank pipe 36 as they are pulled uphole. The packer 26, axially-shiftable element 28, and shifting tool 12 are shown positioned in a portion of the completion structure 10 uphole from the flapper valve 32. This portion of the completion structure 10 has a larger inside bore diameter than the inside bore diameter of the filter elements 24. The amount by which the inside diameters may vary depends on design. However, in many cases, the difference between the diameters can be between three-eighths inch (⅜") to one inch (1"). As explained in detail below, the first and second shifting tool portions 34, 38 have engagement and releasing profiles associated therewith that allow them to engage axially-shiftable elements 28 that have a larger inside bore diameter than the filter elements 24.

The shifting tool 12 of the present invention has a distinct advantage over the prior art in that it is capable of extending to the larger inside bore diameter of the completion structure 10 uphole from the flapper valve 32 while having sufficient structural strength to withstand the forces necessary to shear any applicable shear pins. Further, the first shifting tool portion has an outside diameter that allows it to pass through the filter elements 24. Therefore, it is not necessary to especially design the inside bore diameter of the upper portions of the completion structure 10 to conform to the inside diameter of the filter elements 24. Moreover, the added by-pass area between the blank pipe 36 and the packer mandrel 40, lessens the risk of solids build-up in those areas and prevents a bridging or plugging of the by-pass area.

Figure 1A:
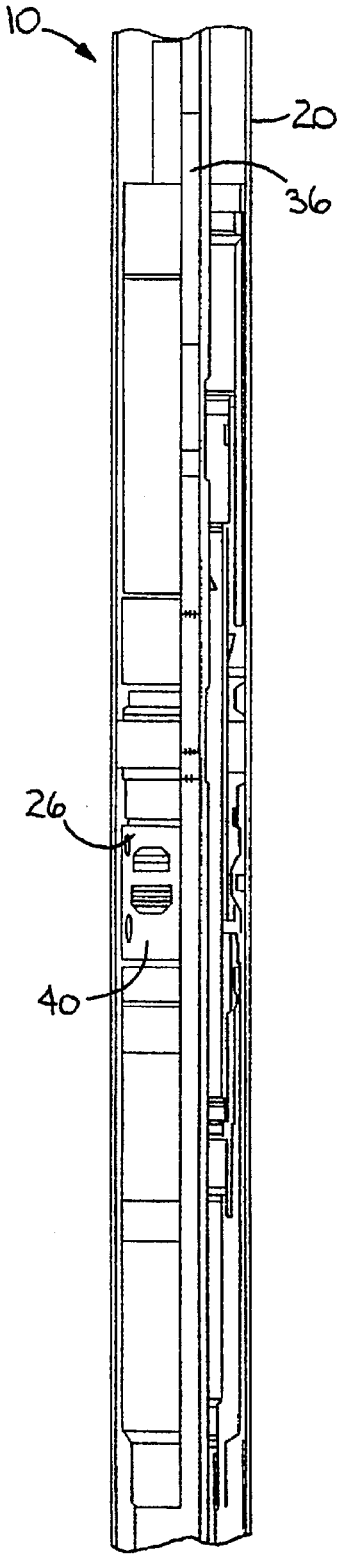
FIG. 1A illustrates a schematic, partial cut-away, view of the upper portion of the completion tool of FIG. 1 illustrating the packer engaged against the interior walls of the well bore casing.
Figure 1B:
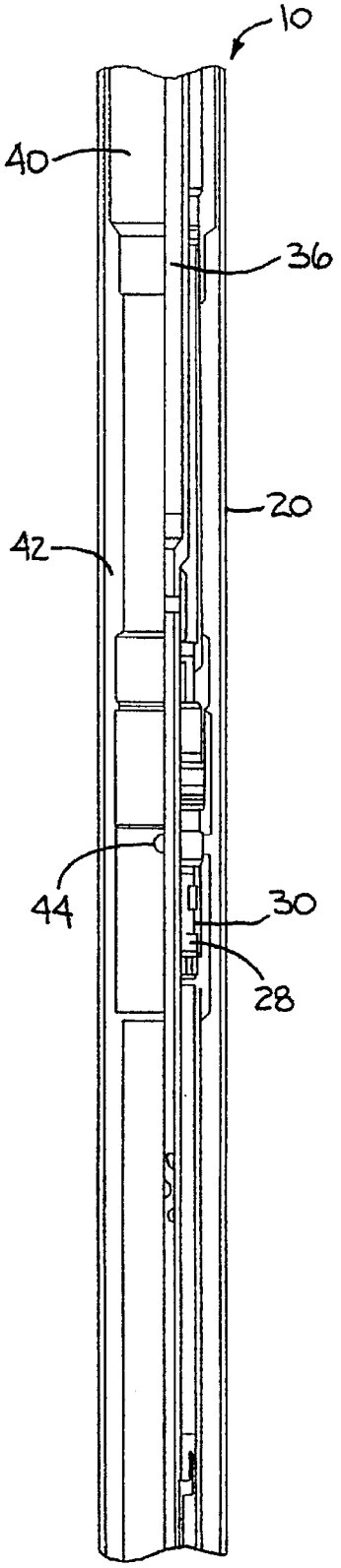
FIG. 1B illustrates a schematic, partial cut-away view of that portion of the completion tool in which the closing sleeve is located.
Figure 1C:
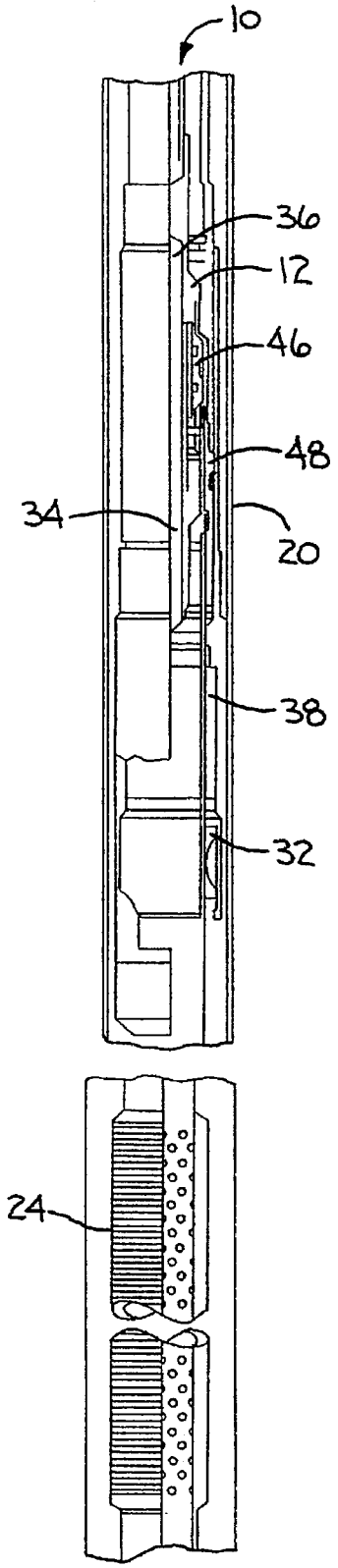
FIG. 1C illustrates a schematic partial cut-away view of shifting tool positioned near the opened flapper valve positioned uphole from the wash screens having a smaller inside bore diameter than the blank pipe positioned uphole.

Turning now to FIGS. 1A, 1B and 1C, there is shown a more detailed general illustration of the completion structure 10 of FIG. 1. In FIG. 1A, the conventional hydraulically actuated packer 26 previously mentioned above is illustrated. Since the detailed structure and operation of the packer 26 is well known, its operation and structure will be only briefly discussed. The packer 26 is actuated by a primary C-ring ball seat (not shown) and by dropping a ball (not shown) on the ball seat. When the ball seats on the C-ring, pressure builds up and forces the hydraulic piston within the packer 26 down and sets the packer 26. Once the packer 26 is set, various completion or testing operations may then be conducted. The ball is expended through the C-ring and then drops to a secondary position within the wash pipe or service tool (not shown).

Referring now to FIG. 1B, there is illustrated the axially-shiftable element 28 that is positioned immediately downhole from the packer 26. The axially shiftable element 28 and the shifting profile 30 preferably define a tubular member that is disposed about the outside diameter of the blank pipe 36. This tubular member is adapted for reciprocal motion from a first open position wherein the fluid's flow path, directed from the annulus 42 between the casing 20 and blank pipe 36, and into the bore of the blank pipe 36, through fluid ports 44 formed in the side of the blank pipe 36, to a second position wherein the ported closing sleeve 28 covers the fluid ports 44, which prevents the fluid flow from entering the interior bore of the blank pipe 36 from the annulus 42.

Referring now to FIG. 1C, there is illustrated the shifting tool 12 of the present invention. In FIG. 1C, the first shifting tool portion 34 is positioned downhole from the ported closing sleeve 28 and is coupled to the blank pipe 36 for movement therewith. As is explained below in more detail, the first shifting tool portion 34 preferably has a first shifting profile 46 associated therewith that engages the second shifting tool portion 38. The first shifting tool portion 34 is adapted (i.e. "designed") to pass through the filter elements 24 that have a lesser inside bore diameter than the blank pipe 36.

The second shifting tool portion 38 has a second shifting profile 48 associated therewith that is engageable with the axially-shiftable element 28. The first shifting profile 46 engages the second shifting tool portion 38 to cause the second shifting tool portion 38 to move in concert with the first shifting tool portion 34. As the blank pipe 36 is pulled uphole, both the first and second shifting tool portions 34, 38 move uphole with the blank pipe 36, causing the second shifting profile 48 to engage and shift the shifting profile 30 of the axially-shiftable element 28 from a first open position to a second closed position.

Figure 2:
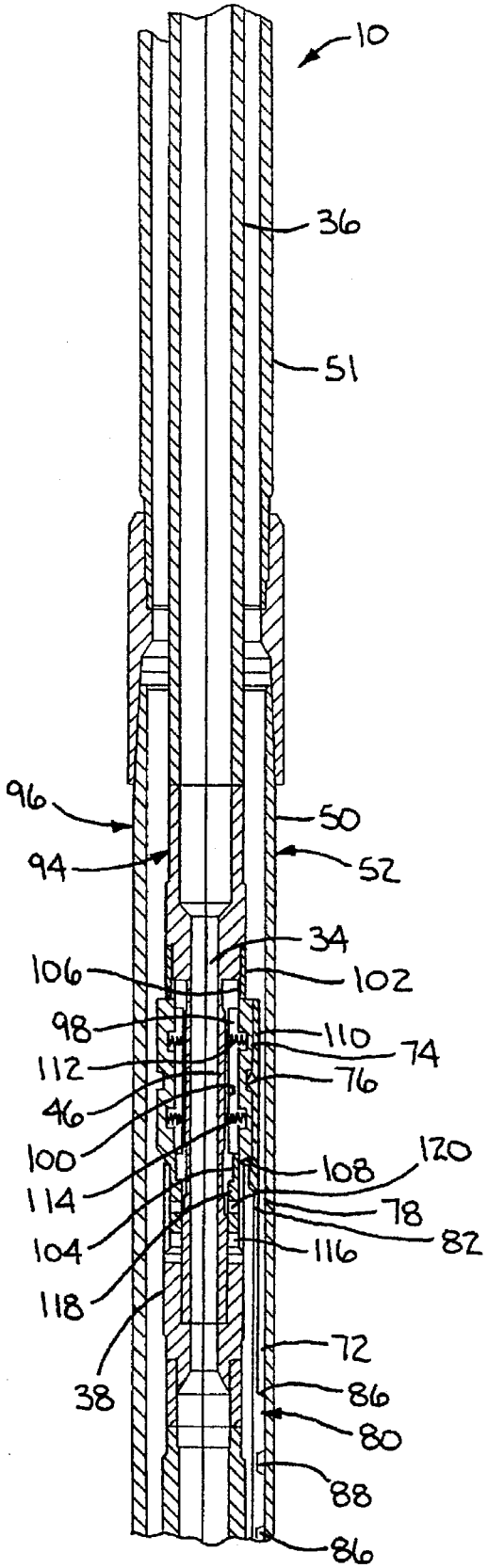
FIG. 2 illustrates a cross-sectional view of the uphole portion of the shifting tool positioned near the opened flapper valve with the first shifting tool engaged with the prop sleeve of the second shifting tool.
Figure 2A:
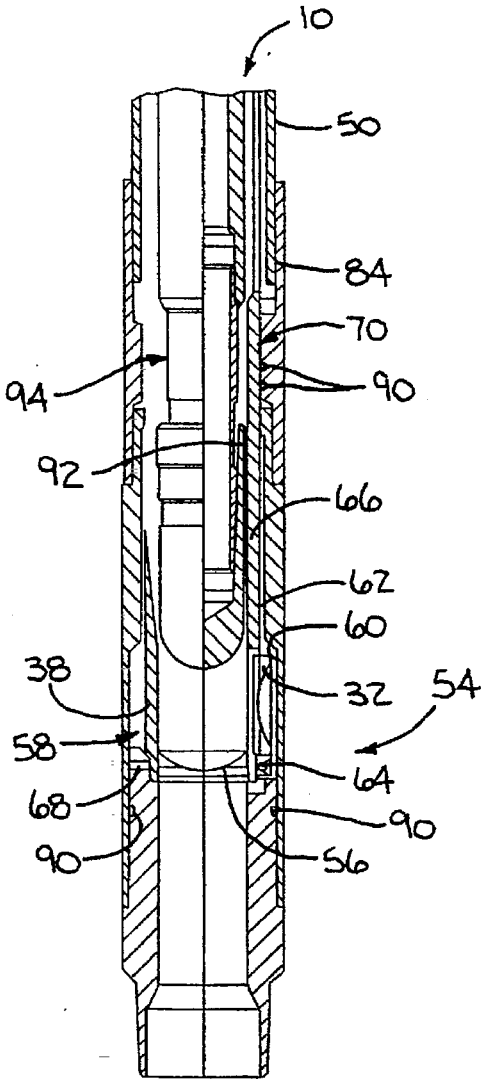
FIG. 2A illustrates a cross-sectional view of the downhole portion of the shifting tool positioned near the opened flapper valve with the prop sleeve of the second shifting tool engaged holding the flapper valve in an open position.

With the overall completion structure 10 having now been explained in general, the shifting tool 12 and the elements cooperable therewith will now be explained in greater detail. Referring to FIGS. 2 and 2A, there is illustrated a partial cross-sectional, cut-away view of a tubular pup joint section 50 threadably coupled to. For purposes of illustration, the tubular pup joint section 50 is shown in two views with the uphole portion illustrated by FIG. 2 and the downhole portion illustrated in FIG. 2A. As shown in FIGS. 2 and 2A, the first shifting tool portion 34 has been pulled uphole and cooperatively engaged with and coupled to the second shifting tool portion 38 such that they are both received within the bore of the pup joint section 50. The pup joint section 50, which is substantially shorter in length than the remainder portions of the the wash pipe 51, has an uphole end 52 that is threadably connected to the uphole section of the wash pipe 51 and a downhole end 54 that is threadably connected to a downhole section of the blank pipe 36. Positioned near the downhole end 54 of the pup joint section 50 is the flapper valve 32 and flapper valve seat 56. The flapper valve 32, which is preferably comprised of a ceramic material, is hingedly received within a recess 58 formed in an interior wall 60 of the pup joint section 50 and is pivotal between a first, open position and a second, closed position. As illustrated, the flapper valve 32 is held in the first open position by the outer wall 62 of the second shifting tool portion 38, which thus eliminates the need for a flapper closing sleeve found in conventional completion structures. When the flapper valve 32 is in an open position, fluids can flow through the pup joint section 50 to distal portions of the well bore. However, when the second shifting tool portion 38 is removed from the pup joint section 50 via the first shifting tool portion 34, the flapper valve 32 is urged to the closed position by a biasing member 64, such as a spring, and seats on the flapper valve seat 56, thus shutting off fluid flow to the distal portions of the well bore.

In a preferred embodiment, the second shifting tool portion 38 is comprised of a prop sleeve 66 that is shearably coupled to the pup joint section 50 by a shear pin 68 located near the downhole end 54 of the pup joint section 50. The prop sleeve 66 is therefore fixed in position within the pup joint section 50 until such time that the prop sleeve 66 is released and removed from the pup joint section 50 via the first shifting tool portion 34. In the preferred embodiment, the prop sleeve 66 is comprised of a downhole section 70, a flexible intermediate section 72 and an uphole section 74.

Formed on the interior side and near the upper end of the uphole section 74 is an engagement shoulder 76 for engaging the first shifting tool portion 34 in a manner described below. Located immediately downhole of the engagement shoulder 76 is a compression shoulder 78 that functions to engage and compress the first shifting tool portion 34 in a manner described below.

Positioned on an outer surface of the intermediate section 72 is a second shifting profile 80. Preferably, the second shifting profile 80 is integrally formed with the outer surface of the intermediate section 72 and is located midway between opposing ends 80,82 of the intermediate section 72. The second shifting profile 80 preferably extends along a portion of the prop sleeve's 66 length and has opposing tapered ends 86 with an engagement shoulder 88 formed intermediate between the opposing tapered ends 86. The second shifting profile 80 extends out to and slidably contacts the interior wall 60 of the pup joint section 50. Thus, it is readily seen that the second shifting profile 80 is capable of engaging axially-shiftable elements that have an inside diameter greater than the inside diameter of the filter elements 24. In a preferred embodiment, the intermediate section 72 is comprised of a plurality of collect finger members that encompass the blank pipe 36 and are joined to the uphole and downhole sections 70,74 of the prop sleeve 66.

The downhole section 74 of the prop sleeve 66 also slidably contacts the interior wall 60 of the pup joint section 50 and forms a seal against "O" rings 90 positioned within the interior wall 60 of the pup joint section 50. The "O" rings 90 are positioned uphole from the flapper valve 32 and when the first shifting tool portion 34 is pulled through the pup joint section 50, rubber cup-type packers 92 that are positioned around the end of first shifting tool portion 34 and the "O" rings 90 cooperate to shut off the fluid flow between the prop sleeve 66 and the interior wall 60 of the pup joint section 50. In addition, the prop sleeve 66 also functions to "prop" or hold the flapper valve 32 in an open position until the prop sleeve 66 is removed from the pup joint section 50 by the first shifting tool portion 34. This is a distinct advantage over the prior art because prior art devices required a closing sleeve to hold the flapper valve in the open position. As the shifting key was pulled through the pup joint, the shifting key would engage the closing sleeve and axially shift it uphole, allowing the flapper valve to pivot to a closed position. The present invention eliminates the need for such a mechanism because the prop sleeve 66 replaces the prior art closing sleeve, which simplifies the structure and reduces its manufacturing cost.

As shown in FIGS. 2 and 2A, the first shifting tool portion 34 has been pulled uphole such that it is received within the prop sleeve 66 that is coupled to and positioned in the pup joint section 50. In a preferred embodiment, the first shifting tool portion 34 has an elongated, tubular shifting body 94 which has an uphole end 96 that is threadably attached to the blank pipe 36. Formed in the uphole end 96 and along the length of the tubular shifting body 94 is a shifting profile pocket 98 for retaining the first shifting profile 46, preferably a shifter key, therein. Both the shifting profile pocket 98 and the first shifting profile 46 are of conventional design and known in the art. The first shifting profile 46 is captured in the shifting profile pocket 76 between a biasing surface 100 and first and second key retainer sections 102, 104 that extend across first and second extension arms 106, 108 of the first shifting profile 46.

The first shifting profile 46 has an outer surface with an engagement shoulder 110 formed therein and an inner surface with a recess 112 formed therein for receiving a biasing member 114, such as a spring, that urges the first shifting profile 46 outwardly from the shifting tool tubular body 94 to engage the engagement shoulder 76 of the second shifting tool portion 38.

Positioned immediately below the shifting profile pocket 98 is a shear ring pocket 116 for retaining a shear ring 118 and shear screw 120 therein. The shear ring 118 is captured within the shear ring pocket by the second key retainer section 104 and is retained in the shear ring pocket by the shear screw 120 and the second key retainer section 104. The shear ring 118 functions to release the first shifting profile 46 from engagement with the second shifting tool portion 38 in the event that the second shifting tool portion 38 becomes stuck in the hole. In such instances, sufficient lifting pressure is applied to the first shifting tool portion 38 to cause the second extension arm 108 of the first shifting profile 46 to apply sufficient force against the shear ring 118 to shear the shear screw 120. When the shear screw 120 is sheared, the shear ring 118 is then able to slide away from the direction of the force within the shear ring pocket 116. This, in turn, allows the second retainer section 104 to cam against the first shifting profile 46 and disengage it from the engagement shoulder 76 of the second shifting tool portion 38, which then allows the first shifting tool portion 34 to be pulled out of the well bore.

Positioned around and near the downhole end of the tubular body 94 is the sealing element 92, such as a rubber cup-type packer. As explained above, this sealing element 92 works in concert with prop sleeve 66 of the second shifting tool portion 38 and the "O" rings 90 to seal off fluid flow between the first and second shifting tools portions 34, 38. This sealing prevents the flapper valve 32 from slamming shut and accidently breaking.

Figure 3:
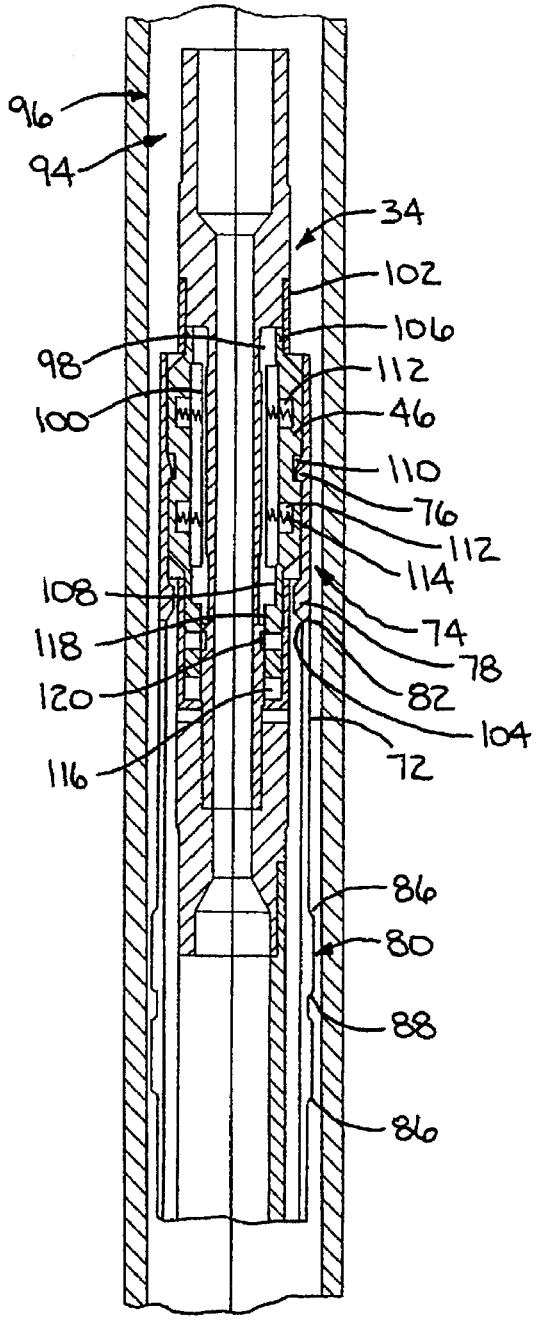
FIG. 3 illustrates a cross-sectional view of the uphole portions of the first and second shifting tools after having been moved uphole to allow the flapper valve to pivot to a closed position.
Figure 3A:
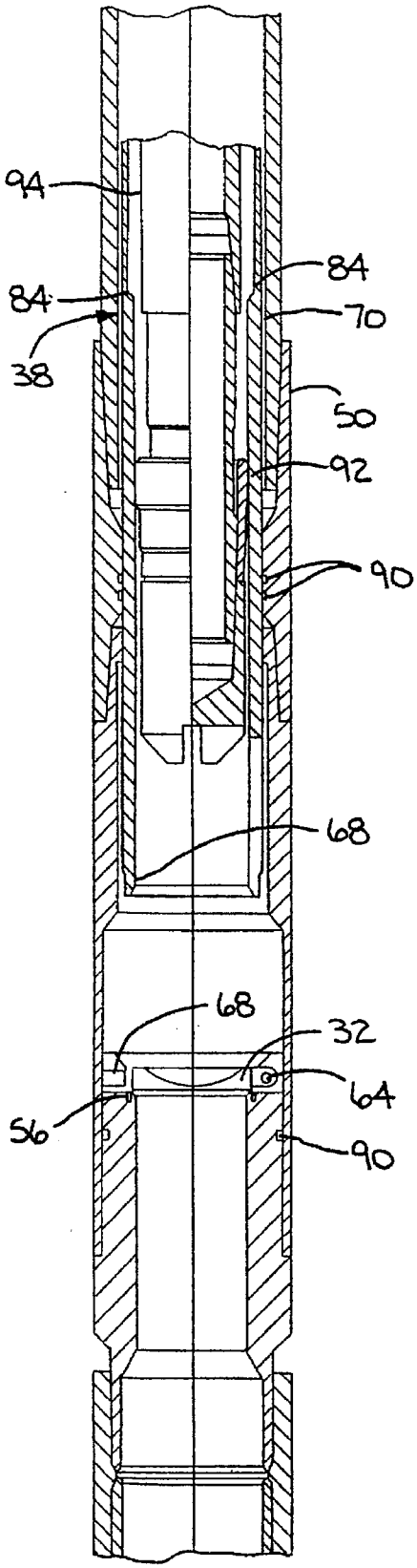
FIG. 3A illustrates a cross-sectional view of the uphole portions of the first and second shifting tools after having been moved uphole to allow the flapper valve to pivot to a closed position.

Turning now to FIGS. 3 and 3A, the first and second shifting tool portions 34,38 are shown in a shifted position such that the flapper valve 32 is seated in the flapper valve seat 56 in the closed position. In the view as illustrated in FIG. 3, the first shifting profile 46 is engaged with the engagement shoulder 76 of the second shifting tool portion 38. With the first shifting tool portion 34 engaged with the second shifting tool portion 38, sufficient lifting force is applied to shear the shear pin 68 that secures the second shifting tool portion 38 within the pup joint section 50. Then second shifting tool portion 38 is then lifted uphole and the downhole section 70 of the prop sleeve 66 is lifted uphole above the flapper valve 32. With the restraining force of the prop sleeve 66 removed, the flapper valve 32 is then urged, via the biasing member 64 to seat on the flapper valve seat 56 in the closed position.

Figure 4:
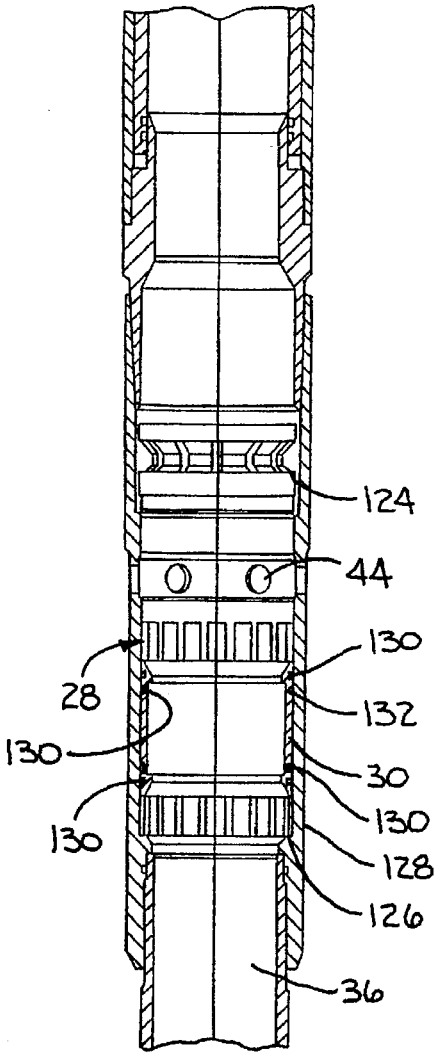
FIG. 4 illustrates an axially-shiftable element positioned uphole from the flapper valve and having a closing sleeve associated therein.

Turning now to FIG. 4, there is illustrated an axially-shiftable element 28. Preferably, the axially-shiftable element 28 is a ported closing sleeve that includes a closing sleeve having the shifting profile 30 as discussed above. However, it should be understood that the axially-shifted element 28 could be a number of apparatuses that are capable of sliding about the blank pipe 36 and between the seal bore 128 and blank pipe 36. The axially-shiftable element 28 and the shifting profile 30 preferably define a tubular member that is disposed about an outside diameter of the blank pipe 36 and is adapted for reciprocal motion from a first, open position to a second, closed position within the seal bore 128. When the tubular member is in the first, open position, the fluid's flow path is directed from the annulus between the casing (not shown) and blank pipe 36 into the bore of the blank pipe 36 through the fluid ports 44 formed in the side of the blank pipe 36. When the tubular member is in the second, closed position, it covers the fluid ports 44, which prevents the fluid flow path from entering the interior bore of the blank pipe 36 from the annulus. The axial reciprocal motion from the first position to the second position is restricted between an upper stopping shoulder 124 and a lower stopping shoulder 126. A plurality of sealing elements 130, such as "O"-rings, are disposed about the exterior of the axially-shiftable member 28 intermediate the fluid ports 44 and ends of the axially-shiftable element 28 to prevent leakage around the axially-shiftable member 28. The shifting profile 30 has an engagement shoulder 132 that is configured to engage the second shifting profile of the second shifting tool portion. As the first and second shifting tool portions are concurrently lifted uphole, the second shifting profile engages the engagement shoulder 132 of the closing sleeve and axially shifts the shifting profile 30 uphole to close the fluid ports 44.

Figure 5:
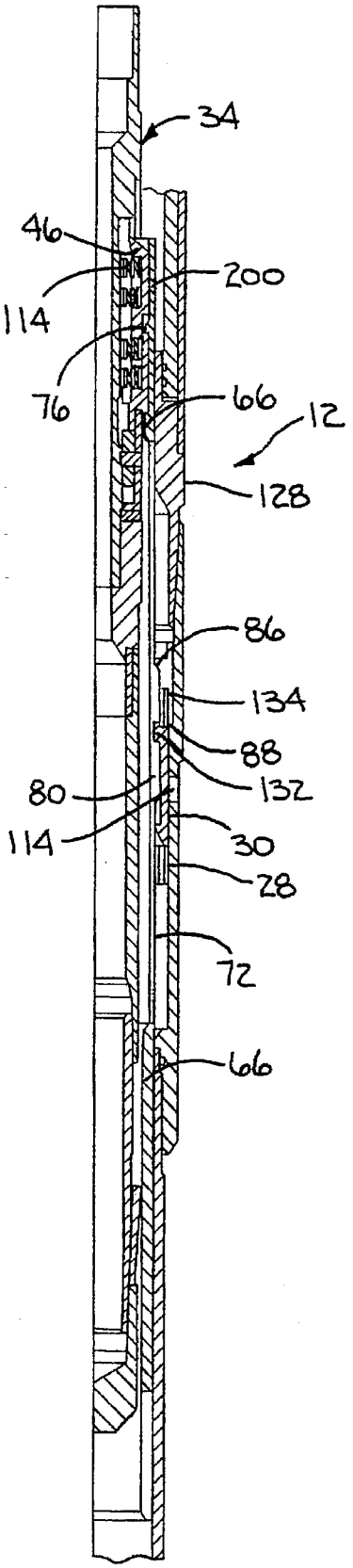
FIG. 5 illustrates a partial cut-away, cross-sectional view of the shifting tool with the second shifting profile engaged with the closing sleeve.

Turning now to FIG. 5, there is illustrated, in a preferred embodiment thereof, a cross-sectional half view of the second shifting tool portion 38 engaged with the axially-shiftable element 28. As seen from FIG. 5, the engagement shoulder 88 of the second shifting profile 80 is engaged with the engagement shoulder 132 of the shifting profile 30. Between the second shifting profile 80 and the first shifting profile 46 is a releasing shoulder 134 that is positioned to engage the first tapered end 86 of the second shifting profile 80 after the shifting profile 30 has been shifted to the second, closed position and as the shifting tool 12 continues to be pulled uphole. As the tapered end 86 contacts the releasing shoulder 134, the releasing shoulder 134 cams up on the tapered end 86, which flexes the intermediate section 72 of the prop sleeve 66 and the second shifting profile 80 inward toward the centerline of the shifting tool 12. This camming action flexes the second shifting profile 80 to such a degree that the engagement shoulder 88 of the second shifting profile 80 disengages from the engagement shoulder 132 of the shifting profile 30, thereby allowing the first and second shifting tool portions 34, 38 to be removed from the well bore.

It should be further noted that extension 200 provides a protective sleeve to key 46 and inhibits the premature release of prop sleeve 66 from the shifting tool 34 as the tools are pulled from the well.

Figure 6:
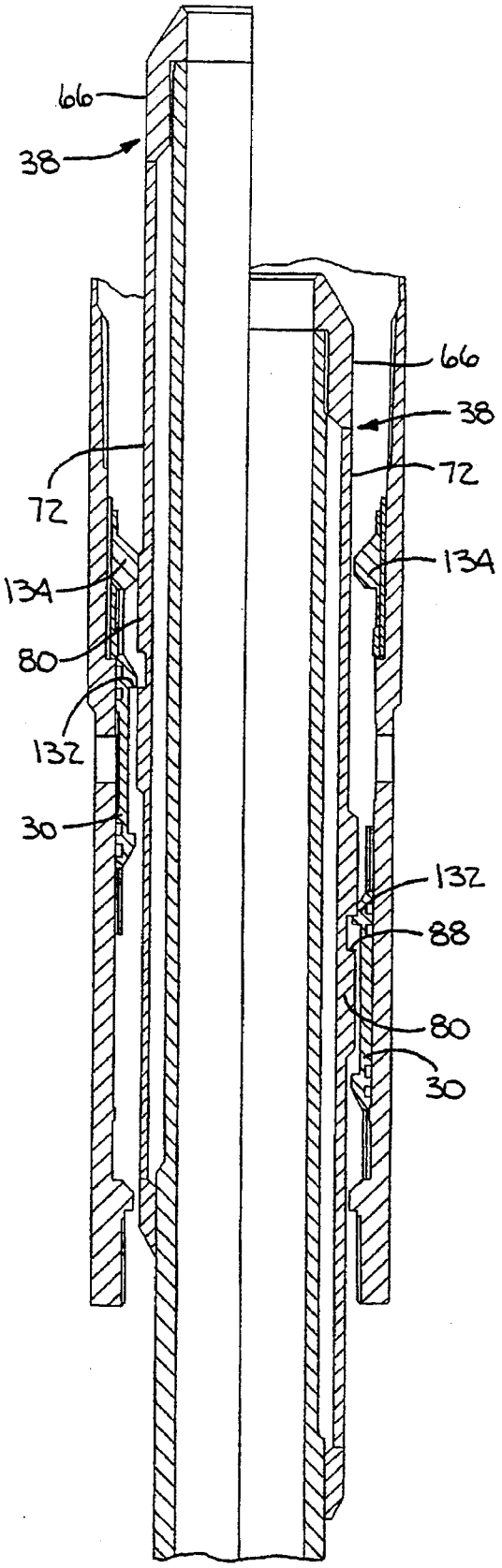
FIG. 6 illustrates a bifurcated cross-sectional of an uphole portion of the alternate embodiment of the shifting tool with the left side of the figure representing the shifting tool in a shifted position and the right side in an unshifted position.
Figure 6A:
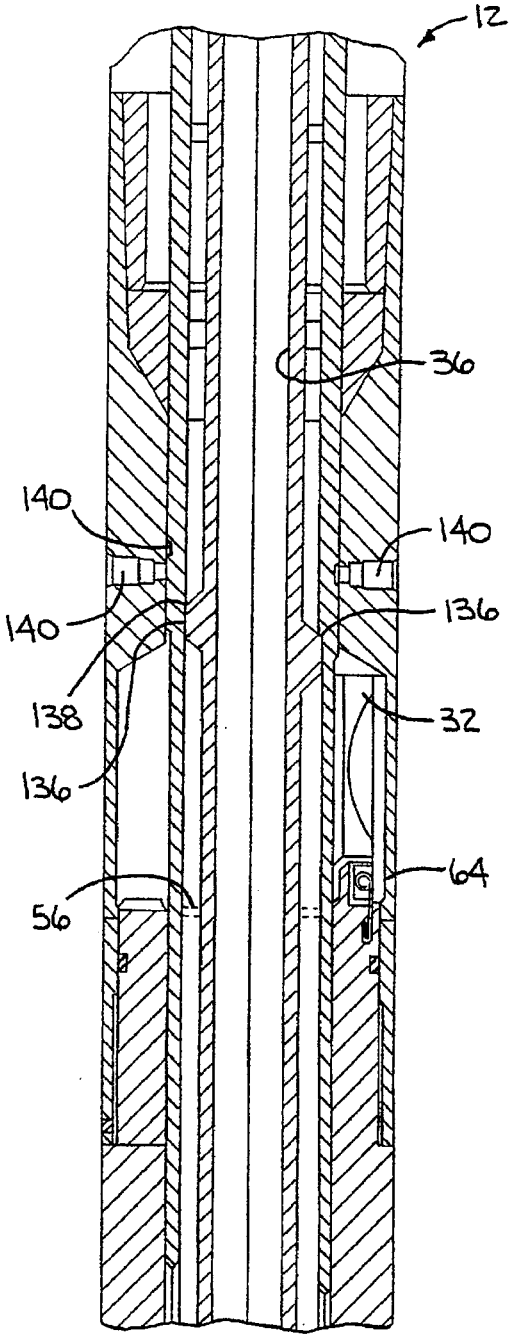
FIG. 6A illustrates a bifurcated cross-sectional of a downhole portion of the alternate embodiment of the shifting tool with the left side of the figure representing the shifting tool in a shifted position and the right side in an unshifted position.

Turning now to FIGS. 6 and 6A, there is illustrated an alternate embodiment of the shifting tool 12 of the present invention. It should be noted that FIG. 6 is the uphole portion of the alternate embodiment and FIG. 6A is the downhole portion and that the left side of FIGS. 6 and 6A represent the shifted position of the first and second shifting tool portions 34, 38 and the right side of FIGS. 6 and 6A represent the unshifted position of the first and second shifting tool portions 34, 38. In FIG. 6, the axially-shiftable element 28 engaged with second shifting profile 80 is illustrated and is identical in structure and function with the embodiment described in FIGS. 4 and 5. However, in FIG. 6A, the first shifting tool portion 34 is different in that the first shifting profile 46 is not a shifting key as previously discussed, but is comprised of a shoulder 136 having a diameter larger than the blank pipe 36 such that the shoulder 136 engages a no-go shoulder 138 formed in the interior wall of the blank pipe 36. As the first shifting tool portion 34 is pulled uphole, the shoulder 136 engages the no-go shoulder 138. As lifting force continues to be applied to the blank pipe 36, the lifting force becomes sufficient to shear the shear pin 140, which allows the blank pipe 36 to be moved uphole, as illustrated in the left side of FIG. 6A. This shearing action, in turn, allows the second shifting profile to engage the shoulder 132 of the axially-shiftable element 28 as shown in FIG. 6. As the end of the blank pipe 36 is pulled uphole past the flapper valve 32, the flapper valve 32 pivots to a closed position and seats on the valve seat 56.

With a detailed description of the present invention having now been described, its method and use will now be discussed with general reference to FIGS. 1–6A. The first shifting tool portion 34 is run to the bottom of the well bore 14 through the blank pipe 36 and the smaller diameter filter elements 24. Once the desired completion and circulation operations are completed, the first shifting tool portion 34 is pulled uphole, via the blank pipe 36 and through the small diameter filter elements 24.

As the first shifting tool portion 34 is pulled through the filter elements 24, the small inside bore diameter of the filter elements 24 may cause the first shifting profile 46 to be biased toward the center line of the shifting tool body 94. As the first shifting tool portion 34 continues to be pulled uphole, it is pulled through the flapper valve seat 56 and into the pup joint section 50. The compression shoulder 78 on the interior wall of the prop sleeve 66 compresses the first shifting profile 46 and causes it to properly engage the engagement shoulder 76 of the second shifting tool portion 38 and couples the second shifting tool portion 38 to the first shifting tool portion 34. At this time, the sealing element 92 cooperates with the "O" rings 90 positioned within the interior wall 60 of the pup joint section 50 and the outer wall of the prop sleeve 66 to form a seal that shuts off fluid flow through the flapper valve seat 56.

Sufficient lifting force is applied to the first shifting tool portion 34 to shear the shear pin 122 that couples the prop sleeve 66 to the pup joint section 50. The first and second shifting tool portions 34, 38 are then lifted uphole. When the downhole end of the prop sleeve 66 is lifted above the flapper valve 32, the biasing member 64 urges the flapper valve 32 to a closed position against the flapper valve seat 56.

When coupled together, the first and second shifting tool portions 34, 38 combine to form the shifting tool 12 having a diameter that is larger than the inside bore diameter of the filter elements 24 and that is capable of engaging axially-shiftable elements in those portions of the completion structure 10 that have diameters larger than the filter elements 24. As the shifting tool 12 continues to be pulled uphole, the second shifting profile 80 positioned on the intermediate section 72 of the prop sleeve 66 engages the engagement shoulder 132 of the axially-shiftable element 28 and axially slides the shifting profile 30 over the fluid ports 44. The tapered end 86 of the second shifting profile 80 then cams up on the releasing shoulder 134 causing the intermediate section 72 to flex inward and disengage the engagement shoulder 132 of the axially-shiftable element 28 from the second shifting profile 80. The shifting tool 12 is then pulled up to the surface and removed from the well bore 14.

As seen from the foregoing, it will be appreciated that the present invention could employ a number of shifting tool portions in a similar manner as just described that engage and couple to one another to form a shifting tool that can accommodate a wide range of diameters.

From the above, it is apparent that the present invention provides, in a well having a substantially annular completion structure therein, a completion structure having portions of lesser and greater inner diameter and an axially-shiftable element associated with the portion of greater inner diameter wherein the axially-shiftable element has an inner diameter greater than a diameter of the portion of lesser inner diameter, a shifting tool for, and method of, axially shifting the axially-shiftable element.

The shifting tool comprises: (1) a first shifting tool portion having a first shifting profile associated therewith, the first shifting tool portion adapted to pass through the portion of lesser inner diameter and (2) a second shifting tool portion having a second shifting profile associated therewith. The first shifting profile is engageable with the second shifting tool portion to cause the second shifting tool portion to move in concert with the first shifting tool portion. The second shifting profile is engageable with the axially-shiftable element to cause the axially-shiftable element to move in concert with the second shifting tool portion. The first and second shifting tool portions thereby cooperate to provide substantial axial forces to shift the axially-shiftable element.

Thus, the present invention introduces a shifting tool that is adapted to shift elements of potentially widely-varying inner diameter. With prior art shifting tools, shiftable elements uphole of the portion of lesser inner diameter were constrained to have an equivalently lesser diameter, thereby undesirably constricting the completion structure and concomitantly limiting access to, and use flexibility of the completion structure. The present invention provides, in effect, a radial expansion member (in the form of the second shifting tool portion) to allow the shifting tool to shift shiftable elements of larger inner diameter without compromising the level of axial forces that can be brought to bear on the shiftable elements.

Although the present invention and its advantages have been described in detail, those skilled in the art should understand that they can make various changes, substitutions and alterations herein without departing from the spirit and scope of the invention in its broadest form.

What is claimed:

1. In a well having a substantially annular completion structure therein, said completion structure having portions of lesser and greater inner diameter and an axially-shiftable element associated with said portion of greater inner diameter, said axially-shiftable element having an inner diameter greater than a diameter of said portion of lesser inner diameter, a shifting tool for axially shifting said axially-shiftable element, comprising:

a first shifting tool portion having a first shifting profile radially movable relative thereto, said first shifting tool portion having an outside diameter of a size sufficient to allow said first tool portion to pass through said portion of lesser inner diameter; and a second shifting tool portion having a second shifting profile associated therewith, said first shifting profile engageable with said second shifting tool portion to cause said second shifting tool portion to move in concert with said first shifting tool portion, said second shifting profile engageable with said axially-shiftable element to cause said axially-shiftable element to move in concert with said second shifting tool portion, said first and second shifting tool portions thereby cooperable to provide substantial axial forces to shift said axially-shiftable element.

2. The shifting tool as recited in claim 1 wherein said first shifting profile is located on a shifter key coupled to said first shifting tool portion.

3. The shifting tool as recited in claim 2 wherein said shifter key has a spring associated therewith, said spring urging said shifter key away from a centerline of said first shifting tool portion.

4. The shifting tool as recited in claim 1 wherein said first shifting profile is integral with an outer surface of said first shifting tool portion.

5. The shifting tool as recited in claim 4 wherein said first shifting profile is a shoulder on said outer surface, said shoulder engageable with said second shifting tool portion.

6. The shifting tool as recited in claim 1 wherein said second shifting profile is integral with an outer surface of said second shifting tool portion.

7. The shifting tool as recited in claim 6 wherein said second shifting profile is located on a plurality of collet fingers formed from said outer surface.

8. The shifting tool as recited in claim 1 wherein said completion structure has a valve member and a valve seat associated therewith, said valve member movable between an open position and a closed position, said second shifting tool retaining said valve member in said open position prior to said movement of said second shifting tool.

9. The shifting tool as recited in claim 8 wherein a shearable element joins said second shifting tool portion to said completion structure subject to application of a predetermined shearing force to said second shifting tool portion.

10. The shifting tool as recited in claim 1 wherein said completion structure comprises a profile retraction structure adapted to engage said second shifting profile to urge said second shifting profile toward a centerline of said second shifting tool portion, said second shifting profile thereby disengageable from said axially-shiftable element.

11. The shifting tool as recited in claim 10 wherein said completion structure further comprises a retention structure for releasably retaining said axially-shiftable element in a selectable one of first and second positions.

12. The shifting tool as recited in claim 1 wherein said first and second shifting tool portions comprise seals for creating a seal for said first and second shifting tool portions, as well as said completion structure, against a flow of fluid.

13. The shifting tool as recited in claim 12 wherein said seals substantially prevent said flow of fluid while said first and second shifting tool portions are moved relative to said completion structure.

14. The shifting tool as recited in claim 1 wherein said second shifting tool portion is movable relative to said completion structure to free a flapper valve associated with said completion structure for rotation relative thereto.

15. The shifting tool as recited in claim 14 wherein said first and second shifting tool portions provide a seal against a flow of fluid, said flapper valve thereby being substantially free of influence by forces generated by said flow of fluid.

16. The shifting tool as recited in claim 1 wherein said completion structure has a radial port associated therewith proximate said axially-shiftable element.

17. The shifting tool as recited in claim 16 wherein said axially-shiftable element is axially shiftable to block said radial port against a flow of fluid.

18. The shifting tool as recited in claim 1 wherein said portion of lesser inner diameter has a screen associated therewith.

19. The shifting tool as recited in claim 18 wherein said first shifting tool portion further has cup packers associated therewith to isolate said screen across a geological formation.

20. The shifting tool as recited in claim 1 wherein said shifting tool is an element of a well completion system within a horizontal well.

21. The shifting tool as recited in claim 1 wherein said shifting tool is an element of a well completion system within a gravel-pack well.

22. The shifting tool as recited in claim 1 further comprising means for moving said shifting tool axially through said well and completion structure.

23. The shifting tool as recited in claim 1 wherein said first and second shifting tool portions are completely removable from said completion structure.

24. The shifting tool as recited in claim 1 wherein said shifting tool is employed to place said completion structure into an operating mode.

25. The shifting tool as recited in claim 1 wherein said shifting tool is couplable to a surface rig that provides forces to shift said shifting tool axially relative to said well.

26. In a well having a substantially annular completion structure therein, said completion structure having portions of lesser and greater inner diameter and an axially-shiftable element associated with said portion of greater inner diameter, said axially-shiftable element having an inner diameter greater than a diameter of said portion of lesser inner diameter, a method of axially shifting said axially-shiftable element with a shifting tool, comprising the steps of:

passing a first shifting tool portion having a first shifting profile radially movable relative thereto, through said portion of lesser inner diameter;

engaging a second shifting tool portion having a second shifting profile associated therewith with said first shifting profile to cause said second shifting tool portion to move in concert with said first shifting tool portion; and further engaging said second shifting profile with said axially-shiftable element to cause said axially-shiftable element to move in concert with said second shifting tool portion, said first and second shifting tool portions thereby cooperable to provide substantial axial forces to shift said axially-shiftable element.

27. The method as recited in claim 26 wherein said first shifting profile is located on a shifter key coupled to said first shifting tool portion.

28. The method as recited in claim 27 wherein said shifter key has a spring associated therewith, said method further comprising the step of urging said shifter key away from a centerline of said first shifting tool portion.

29. The method as recited in claim 26 wherein said first shifting profile is integral with an outer surface of said first shifting tool portion.

30. The method as recited in claim 29 wherein said first shifting profile is a shoulder on said outer surface, said method further comprising the step of engaging said shoulder with said second shifting tool portion.

31. The method as recited in claim 26 wherein said second shifting profile is integral with an outer surface of said second shifting tool portion.

32. The method as recited in claim 31 wherein said second shifting profile is located on a plurality of collet fingers formed from said outer surface.

33. The method as recited in claim 26 wherein said completion structure has a valve member and a valve seat associated therewith, said method further comprising the step of retaining said valve member in an open position prior to moving said second shifting tool portion.

34. The method as recited in claim 33 wherein a shearable element joins said second shifting tool portion to said completion structure subject to application of a predetermined shearing force to said second shifting tool portion.

35. The method as recited in claim 26 wherein said completion structure comprises a profile retraction structure adapted to engage said second shifting profile to urge said second shifting profile toward a centerline of said second shifting tool portion, said method further comprising the step of disengaging said second shifting profile from said axially-shiftable element.

36. The method as recited in claim 35 wherein said completion structure further comprises a retention structure for releasably retaining said axially-shiftable element in a selectable one of first and second positions.

37. The method as recited in claim 26 wherein said first and second shifting tool portions comprise seals for creating a seal for said first and second shifting tool portions, as well as said completion structure, against a flow of fluid.

38. The method as recited in claim 37 wherein said seals substantially prevent said flow of fluid while said first and second shifting tool portions are moved relative to said completion structure.

39. The method as recited in claim 26 wherein said second shifting tool portion is movable relative to said completion structure to free a flapper valve associated with said completion structure for rotation relative thereto.

40. The method as recited in claim 39 wherein said first and second shifting tool portions provide a seal against a flow of fluid, said method further comprising the step of substantially freeing said flapper valve of influence by forces generated by said flow of fluid.

41. The method as recited in claim 26 wherein said completion structure has a radial port associated therewith proximate said axially-shiftable element.

42. The method as recited in claim 41 wherein said axially-shiftable element is axially shiftable to block said radial port as against a flow of fluid.

43. The method as recited in claim 26 wherein said portion of lesser inner diameter has a screen associated therewith.

44. The method as recited in claim 43 wherein said first shifting tool portion further has cup packers associated therewith to isolate said screen across a geological formation.

45. The method as recited in claim 26 wherein said well is a horizontal well.

46. The method as recited in claim 45 wherein said well is a gravel-pack well.

47. The method as recited in claim 26 further comprising the step of moving said shifting tool axially through said well and completion structure.

48. The method as recited in claim 26 further comprising the step of completely removing said first and second shifting tool portions from said completion structure.

49. The method as recited in claim 26 further comprising the step of employing said shifting tool to place said completion structure into an operating mode.

50. The method as recited in claim 26 further comprising the step of providing forces to shift said shifting tool axially relative to said well with a surface rig.

51. In a well having a substantially annular completion structure therein, said completion structure having portions of lesser and greater inner diameter and an axially-shiftable element associated with said portion of greater inner diameter, said axially-shiftable element having an inner diameter greater than a diameter of said portion of lesser inner diameter, a shifting tool for axially shifting said axially-shiftable element, comprising:

a first shifting tool portion having a first shifting profile associated therewith, said first shifting tool portion having an outside diameter of a size sufficient to allow said first shifting profile tool portion to pass through said portion of lesser inner diameter; and a second shifting tool portion having a second shifting profile associated therewith, said second shifting profile located on a plurality of collet fingers formed from an outer surface of said second shifting tool portion, said first shifting profile engageable with said second shifting tool portion to cause said second shifting tool portion to move in concert with said first shifting tool portion, said second shifting profile engageable with said axially-shiftable element to cause said axially-shiftable element to move in concert with said second shifting tool portion, said completion structure including:

a profile retraction structure adapted to engage said second shifting profile to urge said second shifting profile toward a centerline of said second shifting tool portion, said second shifting profile thereby disengageable from said axially-shiftable element, and a retention structure for releasably retaining said axially-shiftable element in a selectable one of first and second positions, said first and second shifting tool portions thereby cooperable to provide substantial axial forces to shift said axially-shiftable element.

52. The shifting tool as recited in claim 51 wherein said first shifting profile is located on a shifter key coupled to said first shifting tool portion and said shifter key has a spring associated therewith, said spring urging said shifter key away from a centerline of said first shifting tool portion.

53. The shifting tool as recited in claim 51 wherein said first shifting profile is a shoulder integral with an outer surface of said first shifting tool portion, said shoulder engaging with said second shifting tool portion.

54. The shifting tool as recited in claim 51 wherein said completion structure has a valve member and a valve seat associated therewith, said valve member movable between an open position and a closed position, said second shifting tool retaining said valve member in said open position prior to said movement of said second shifting tool, a shearable element joining said second shifting tool portion to said completion structure subject to application of a predetermined shearing force to said second shifting tool portion.

55. The shifting tool as recited in claim 51 wherein said first and second shifting tool portions comprise seals for creating a seal for said first and second shifting tool portions, as well as said completion structure, against a flow of fluid, said seals substantially preventing said flow of fluid while said first and second shifting tool portions are moved relative to said completion structure.

56. The shifting tool as recited in claim 51 wherein said second shifting tool portion is movable relative to said completion structure to free a flapper valve associated with said completion structure for rotation relative thereto, said first and second shifting tool portions providing a seal as against a flow of fluid, said flapper valve thereby being substantially free of influence by forces generated by said flow of fluid.

57. The shifting tool as recited in claim 51 wherein said completion structure has a radial port associated therewith proximate said axially-shiftable element, said axially-shiftable element axially shiftable to block said radial port as against a flow of fluid.

58. The shifting tool as recited in claim 51 wherein said portion of lesser inner diameter has a screen associated therewith, said first shifting tool portion further having cup packers associated therewith to isolate said screen across a geological formation.

59. The shifting tool as recited in claim 51 wherein said well is a horizontal well.

60. The shifting tool as recited in claim 51 wherein said well is a gravel-pack well.

61. The shifting tool as recited in claim 51 further comprising means for moving said shifting tool axially through said well and completion structure.

62. The shifting tool as recited in claim 51 wherein said first and second shifting tool portions are completely removable from said completion structure.

63. The shifting tool as recited in claim 51 wherein said shifting tool is employed to place said completion structure into an operating mode.

64. The shifting tool as recited in claim 51 wherein a surface rig provides forces to shift said shifting tool axially relative to said well.

65. In a well having a substantially annular completion structure therein, said completion structure having portions of lesser and greater inner diameter and an axially-shiftable element associated with said portion of greater inner diameter, said axially-shiftable element having an inner diameter greater than a diameter of said portion of lesser inner diameter, a method of axially shifting said axially-shiftable element with a shifting tool, comprising the steps of:

passing a first shifting tool portion having a first shifting profile associated therewith through said portion of lesser inner diameter;

engaging a second shifting tool portion having a second shifting profile associated therewith, said second shifting profile located on a plurality of collet fingers formed from an outer surface of said second shifting tool portion, with said first shifting profile to cause said second shifting tool portion to move in concert with said first shifting tool portion; and further engaging said second shifting profile with said axially-shiftable element to cause said axially-shiftable element to move in concert with said second shifting tool portion, said completion structure including:

a profile retraction structure adapted to engage said second shifting profile to urge said second shifting profile toward a centerline of said second shifting tool portion, said second shifting profile thereby disengageable from said axially-shiftable element, and a retention structure for releasably retaining said axially-shiftable element in a selectable one of first and second positions, said first and second shifting tool portions thereby cooperable to provide substantial axial forces to shift said axially-shiftable element.

66. The method as recited in claim 65 wherein said first shifting profile is located on a shifter key coupled to said first shifting tool portion and said shifter key has a spring associated therewith, said method further comprising the step of urging said shifter key away from a centerline of said first shifting tool portion.

67. The method as recited in claim 65 wherein said first shifting profile is a shoulder integral with an outer surface of said first shifting tool portion, said method further comprising the step of engaging said shoulder with said second shifting tool portion.

68. The method as recited in claim 65 wherein said completion structure has a valve member and a valve seat associated therewith, said valve member movable between an open position and a closed position, said second shifting tool retaining said valve member in said open position prior to said movement of said second shifting tool, said method further comprising the step of joining said second shifting tool portion to said completion structure with a shearable element subject to application of a predetermined shearing force to said second shifting tool portion.

69. The method as recited in claim 65 wherein said first and second shifting tool portions comprise seals for creating a seal for said first and second shifting tool portions, as well as said completion structure, against a flow of fluid, said method further comprising the step of substantially preventing said flow of fluid while said first and second shifting tool portions are moved relative to said completion structure.

70. The method as recited in claim 65 wherein said second shifting tool portion is movable relative to said completion structure to free a flapper valve associated with said completion structure for rotation relative thereto, said method further comprising the step of providing a seal against a flow of fluid, said flapper valve thereby being substantially free of influence by forces generated by said flow of fluid.

71. The method as recited in claim 65 wherein said completion structure has a radial port associated therewith proximate said axially-shiftable element, said method further comprising the step of axially shifting said axially-shiftable element to block said radial port as against a flow of fluid.

72. The method as recited in claim 65 wherein said portion of lesser inner diameter has a screen associated therewith, said method further comprising the step of positioning cup packers associated with said first shifting tool portion to isolate said screen across a geological formation.

73. The method as recited in claim 65 wherein said well is a horizontal well.

74. The method as recited in claim 65 wherein said well is a gravel-pack well.

75. The method as recited in claim 65 further comprising the step of moving said shifting tool axially through said well and completion structure.

76. The method as recited in claim 65 further comprising the step of completely removing said first and second shifting tool portions from said completion structure.

77. The method as recited in claim 65 further comprising the step of employing said shifting tool to place said completion structure into an operating mode.

78. The method as recited in claim 65 further comprising the step of providing forces to shift said shifting tool axially relative to said well with a surface rig.

* * * * *